United States Patent [19]

Asano

[11] 4,165,719

[45] Aug. 28, 1979

[54] EMISSION CONTROL APPARATUS FOR INTERNAL COMBUSTION ENGINES WITH A CONTROLLABLY DISABLED CLAMPING CIRCUIT

[75] Inventor: Masaharu Asano, Yokosuka, Japan

[73] Assignee: Nissan Motor Company, Limited, Japan

[21] Appl. No.: 752,965

[22] Filed: Dec. 21, 1976

[30] Foreign Application Priority Data

Dec. 27, 1975 [JP] Japan ..... 50/155772

[51] Int. Cl.[2] ..... F02B 3/00

[52] U.S. Cl. ..... 123/32 EE

[58] Field of Search ..... 123/32 EE, 32 EA, 119 EC

[56] References Cited

U.S. PATENT DOCUMENTS 3,916,170 10/1975 Norimatsu et al. ..... 123/32 EE 3,916,848 11/1975 Schmidt ..... 123/32 EE

*Primary Examiner*—Charles T. Jordan

*Attorney, Agent, or Firm*—Robert E. Burns; Emmanuel J. Lobato; Bruce L. Adams

[57] ABSTRACT

Emission control apparatus for internal combustion engine includes an exhaust composition sensor to sense the mixture ratio, a circuit for clamping the mixture ratio to a predetermined constant value to prevent the mixture from becoming too rich or too lean when a failure should occur in the control loop, for example, in the exhaust composition sensor fail and a circuit for interrupting the clamping circuit when the engine operating condition is such that the sensor is caused to produce low voltage signals although the sensor is functioning properly.

11 Claims, 5 Drawing Figures

30
MONOSTABLE MVTR
RL5
T14
31
T13
MS3
TO INTEGRATOR 25
Vcc
RL3
T9
T8
T7
23
22
20
R14
C5
21
D4
R15
SW5
FROM OXYGEN SENSOR 10

EMISSION CONTROL APPARATUS FOR INTERNAL COMBUSTION ENGINES WITH A CONTROLLABLY DISABLED CLAMPING CIRCUIT

THE FIELD OF THE INVENTION

The present invention relates to closed-loop emission control apparatus for internal combustion engines which is operable in a clamped mode in the absence of the fluctuation of a sensed concentration of an exhaust emission, and in particular to such apparatus wherein the clamp mode is disabled during the start of the engine or deceleration.

BACKGROUND OF THE INVENTION

In a closed-loop emisson control system for internal combustion engines, the concenration fo of exhaust composition is detected to represent the mixture ratio of air-to-fuel combusted in the cylinder in a given cycle in order to control the mixture ratio in a subsequent cylinder cycle in such manner that the difference between the sensed ratio and a desired value is compensated. Conventionally, residual oxygen is sensed by a zirconium type oxygen sensor which provides an output having a sharp characteristic change in the vicinity of the stoichiometric air-fuel ratio. However, the conventional oxygen sensor is limited in performance by the temperature of the exhaust emissions. Therefore, it is sometimes the case that the output of the sensor remains at a low voltage level during the start of the engine or when fuel supply is cut off upon sudden deceleration of the engine. A similar situation occurs when the sensor should fail. With the sensor output being at the low or zero voltage level, the control signal would be such that an extremely rich mixture is supplied to the engine irrespective of the engine operating conditions.

A prior art emissiion control system utilizes the fluctuation of the sensed oxygen concentration due to the inherent transport delay time of the engine as a signal for determining the performance of the exhaust sensor. If the fluctuation ceases, a detector senses the absence of the fluctuation to clamp the air-fuel ratio to a constant value to prevent the mixture from becoming too rich or too lean. Although such clamping action is advantageous when the sensor should fail, it is disadvantageous during sudden deceleration and particularly when the engine is restarted after warm-up operation. Upon restart of the engine after warm-up operation, the mixture is leaned and the output of the exhaust gas sensor remains low so that the detecting circuit permits the clamping circuit to operate to cause the engine to run under an open loop control mode. Therefore, as long as the lean mixture condition exists the closed control operation is disabled generating noxious exhaust components to the atmosphere even though the gas sensor is working properly.

SUMMARY OF THE INVENTION

An object of the present invention is to provide emission control apparatus which is free from the abovementioned disadvantage while assuring the clamping action when the exhaust composition sensor should fail.

Another object of the invention is to provide emission control apparatus which reduces the amount of noxious emissions when the engine operating condition is such that the sensor is adversely affected in performance.

A further object of the invention is to provide emission control apparatus which comprises a disabling circuit for disabling the clamping action while there exists such engine operating condition which would otherwise caused the exhaust sensor to produce low voltage signals over a prolonged length of time.

A still further object of the invention is to provide emission control apparatus in which means are provided to interrupt clamping action at intervals and the interruption is counted to determine whether the exhaust sensor has actually failed.

BRIEF DESCRIPTION OF THE DRAWINGS

These and other objects and advantages of the invention will be understood from the following description taken in conjunction with the accompanying drawings, in which.

DESCRIPTION OF THE PREFERRED EMBODIMENTS

Figure 1:
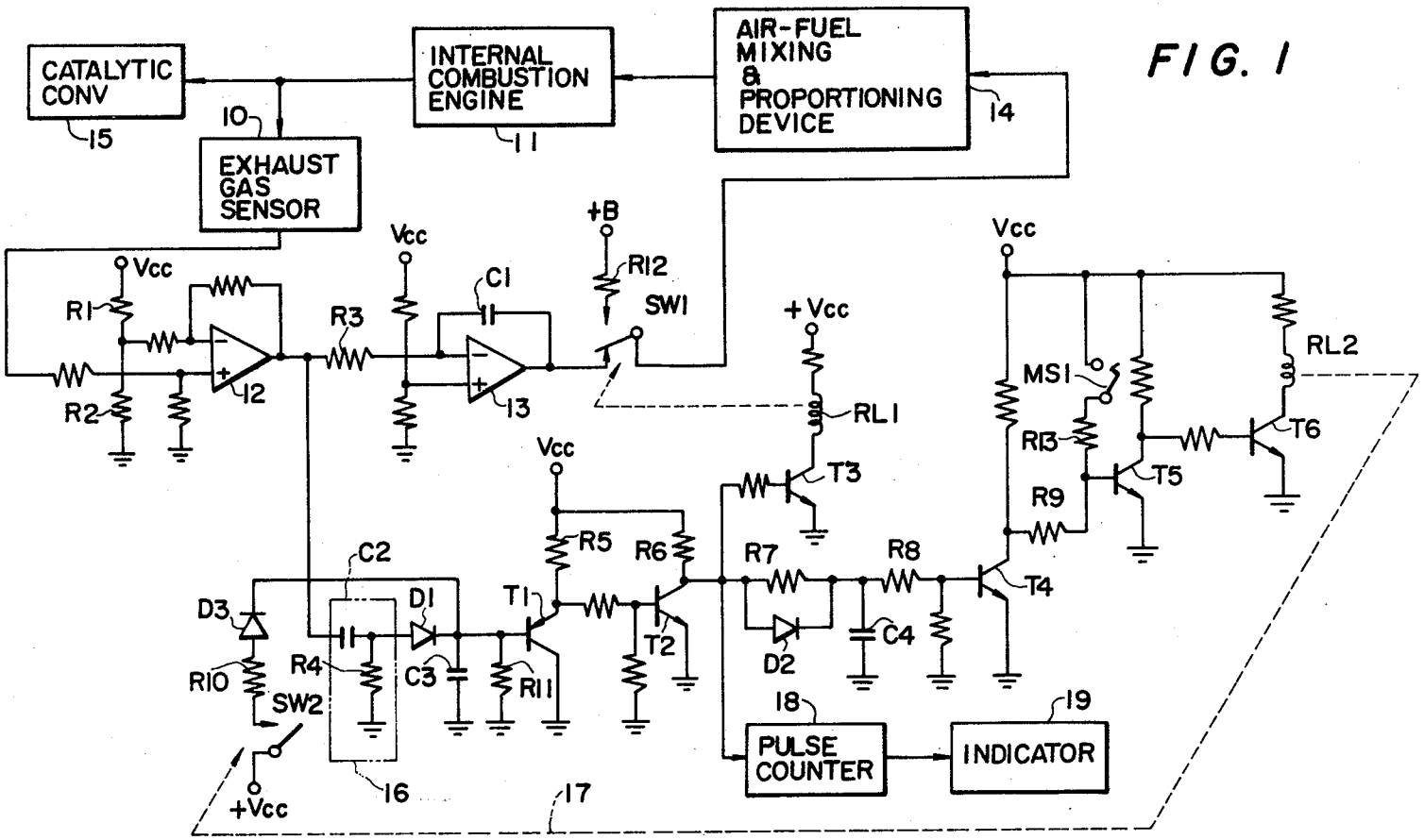
FIG. 1 is a circuit diagram of an embodiment of the invention.

Emission control apparatus embodying the invention is shown in FIG. 1 comprising an exhaust composition sensor 10 disposed in the exhaust passage of an internal combustion engine 11 to detect the concentration of an exhaust composition, oxygen for example, in the emissions to generate an output having a sharp characteristic change in amplitude in the vicinity of the stoichiometric value of the air-fuel mixture. Such output characteristic is provided by a conventional zirconium type oxygen sensor wherein the output is high in amplitude at air-fuel ratios smaller than stoichiometric (rich mixture) and low in amplitude at ratios greater than stoichiometry (lean mixture).

The output of the exhaust composition sensor 10 is connected to the noninverting input of an operational amplifier (differential amplifier) 12 for comparison with a reference voltage on the inverting input thereof supplied from a voltage divider formed by resistors R1 and R2. The output from the amplifier 12 is a result of the comparison in the form of a positive polarity output when the sensor output is greater than the reference voltage and a negative polarity output when the situation is reversed.

The output from the operational amplifier 12 is connected to the inverting input of an integral controller formed by an operational amplifier 13 through resistor R3. Integration is provided by an integrating capacitor C1 coupled between the inverting input and output terminals of the operational amplifier 13 and the rate of integration is determined by the time constant value R3C1. The noninverting input of amplifier 13 is connected to a voltage divider.

The output of the integral controller 13 is connected through relay contact unit SW1 to air-fuel mixing and proportioning device 14 which may be a valve-operated carburetor or fuel injection type device. In response to the integrated output, the proportioning device 14 provides mixing and proportioning of air and fuel and supplies the mixture to the internal combustion engine 11. When the sensed oxygen concentration represents a mixture value leaner than stoichiometry, the integrator delivers an error correction signal that enriches the mixture. Conversely, when the sensed mixture is richer than stoichiometry, the direction of control is reversed so that the mixture is controlled at the stoichiometric value. A three-way catalytic converter 15 is disposed in the exhaust passage at the downstream side of the sensor 10 to provide simultaneous reduction of the noxious components, with its conversion efficiency being at a maximum when the mixture is controlled in the neighborhood of stoichiometry.

Since the oxygen sensor 10 is exposed to a high temperature environment, its characteristic is temperature dependent and its performance is liable to degradation with time. Particularly, when the engine is started or idled, the temperature of exhaust passage is relatively low and as a consequence the voltage output from the oxygen sensor does not faithfully represents the air-fuel mixture ratio.

Furthermore, it is to be noted that due to the transport delay time of the engine there is an inherent time lag in the control system in responding to the input control signal, and therefore control oscillation is normally present when the air-fuel mixture is controlled in a closed loop mode.

The output from the differential amplifier 12 is connected to a differentiator circuit 16 formed by capacitor C2 and resistor R4 coupled to ground. The junction point between capacitor C2 and resistor R4 is connected to the anode terminal of a diode D1, the cathode terminal of which is connected to the base electrode of a transistor T1, the collector and emitter of which are connected to a voltage supply Vcc through load resistor R5 and to ground, respectively. A storage capacitor C3 is connected to the cathode terminal of the diode D1 to be charged by the positive-poled differentiated signal to develop a voltage as an input to the base of transistor T1.

The transistor T1 is switched on when the storage capacitor C3 is discharged through resistor R11 and the voltage thereacross falls below a predetermined level to provide a low-level output to the base of a transistor T2 to turn it off. The turn-off of transistor T2 provides a high-voltage output on its collector connected through load resistor R6 to the voltage supply Vcc. Under this circumstance, transistor T3 will be switched on to draw current through a relay coil RL1 from voltage supply Vcc. The relay RL1 has its contact SW1 connected between the output of integral controller 13 and the input to the air-fuel mixing device 14. The relay contact SW1 is a transfer type contact which is arranged to permit the engine to operate in the closed loop mode when relay RL1 is not energized and permit the engine to operate in the open loop control mode by supplying a control voltage of suitable value from voltage supply +B to the air-fuel mixing device when relay RL1 is energized. In the open loop mode the system is clamped to a constant value irrespective of the sensed air-fuel ratio.

The collector of transistor T2 is also connected to the anode terminal of a diode D2, with its cathode terminal being connected to the base of transistor T4 through resistor R8. The diode D2 is in shunt with a resistor R7. Between the cathode terminal of diode D2 and resistor R8 is disposed a storage capacitor C4 coupled to ground which is charged when the diode D2 is forwardly biased by the high-level output at the collector of transistor T2 while the system is being clamped. Transistor T4 is switched on when the voltage across capacitor C4 reaches the threshold level of the pn junction of transistor T4. A transistor T5 is provided with its base connected to the collector of transistor T4 through resistor R9. To the base of transistor T5 is also connected a DC potential from voltage supply Vcc through normally open contact unit MS1. The contact unit MS1 is a manual switch to be operated by the vehicle driver. The contact Msl is operated to apply the biasing potential to the base of transistor T5 through resistor R13 to render the same to conduct irrespective of the conducting state of transistor T4.

The collector of transistor T5 is connected to the base of transistor T6, with its collector being connected through a relay coil RL2 to the voltage supply Vcc.

Between the storage capacitor C3 and the voltage supply Vcc is provided a clamp release circuit formed by a diode D3, a resistor R10 and a normally open switch contact SW2 which is operated to complete the clamp release circuit in response to the energization of the relay RL2 as indicated by broken lines 17. Diode D3 is connected in a sense to apply recharging potential to the storage capacitor C3 upon completion of the circuit.

In the operation of the circuit of FIG. 1, it is assumed in the first place that the oxygen sensor 10 is working properly so that the output from the operational amplifier 12 fluctuates above and below the reference value as the system oscillates as previously described. As long as the system oscillates, output is delivered from the differentiator 16 to charge the capacitor C3 to build up voltage thereacross which, upon reaching the predetermined voltage level, causes transistor T1 to turn off. Therefore, under normal operating conditions, transistor T1 is switched off and transistor T3 remains nonconductive and the output from the integral controller 13 is coupled to the air-fuel mixing and proportioning device 14.

Figure 5:
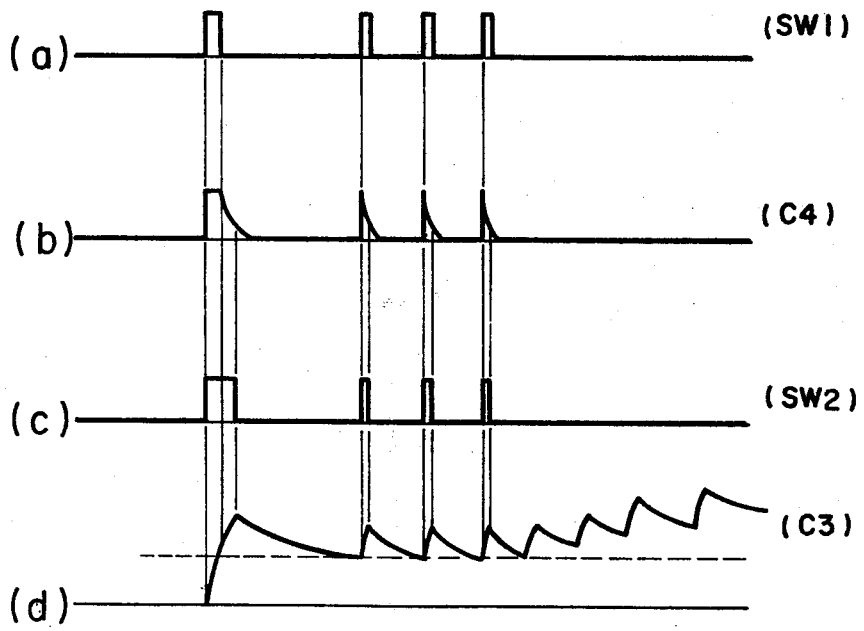
FIG. 5 is a waveform diagram useful for describing the operation of FIG. 1.

During start-up or idling conditions, the output level of the oxygen R15. 10 remains at low voltage level and the capacitor C3 develops no voltage. This turns on transistor T1, turns off transistor T2 and then turns on transistor T3. Thus, relay RL1 is energized to operate it contact SW1 as shown in FIG. 5*a* and the system is clamped. The high potential at the collector of transistor T2 charges capacitor C4 through diode D2 (FIG. 5*b*) and biases transistor T4 into conduction. Transistor T5 is switched off, which in turn switches on transistor T6 to energize relay RL2. Switch contact SW2 is closed and capacitor C3 is charged through diode D3 (FIGS. 5*c* and 5*d*) so that transistor T1 is turned off resulting in the de-energization of relay RL1 to disable the clamped or open loop control mode. In response to the turn-off transistor T1, transistor T2 is turned on to provide a discharge path to the capacitor C4 so that transistor R4 is turned off and as a result relay RL2 is de-energized to open relay contact SW2. Capacitor C3 discharges its stored energy until transistor T1 is turned on whereupon transistor T2 is turned off to charge capacitor C4. This process will be repeated as long as the exhaust composition sensor 10 output remains and as a result the engine is operated in closed and open loop control modes in succession.

After the engine has warmed up, the exhaust sensor 10 becomes operational and generates a fluctuating voltage and transistor T1 is turned off to operate the system in a closed loop mode. If the sensor 10 has failed, pulses will be continuously generated from the collector of transistor T2.

To determine whether the oxygen sensor 10 has actually failed or simply becomes inoperative due to the low exhaust temperature during start-up or due to fuel cut-off under deceleration, a pulse counter 18 is connected to the connector of transistor T2 to respond to transitions of the engine operating condition between closed and open loop modes to generate an output when a predetermined number of such transitions are counted as an indication that the sensor 10 has failed. The output signal from the counter 18 activates an indicator 19 to alert the vehicle occupant, who is response to the indication would actuate the switch MSl. Transistor T5 is turned on to turn off transistor T6 so that recharging action for capacitor C3 is discontinued and relay RL1 is operated to clamp the control system.

If the predetermined count has not been reached in the counter, no indication will be provided and the system will assume its normal oscillatory control action as described before, and the capacitor C3 will be charged up to turn off transistor T1 and relay RL1 will thus remain de-energized (FIG. 5*d*).

When the system is allowed to operate in the closed loop mode in response to the charging of capacitor C3 in the absence of a valid control signal from the gas sensor 10, the integrator 13 will provide a correction signal so that the mixture is automatically enriched, which results in the mixture osciollating about the desired value and capacitor C3 is charged up to cause the system to remain in the closed loop control mode. Therefore, upon restart of engine after warmup operation, the engine is automatically operated under the closed loop mode even though the air-fuel mixture is leaned.

By intermittent disabling of the clamping action, the disadvantage as encountered with the prior art apparatus during the restarting of the engine after warm-up operation, is successfully eliminated.

Figure 2:
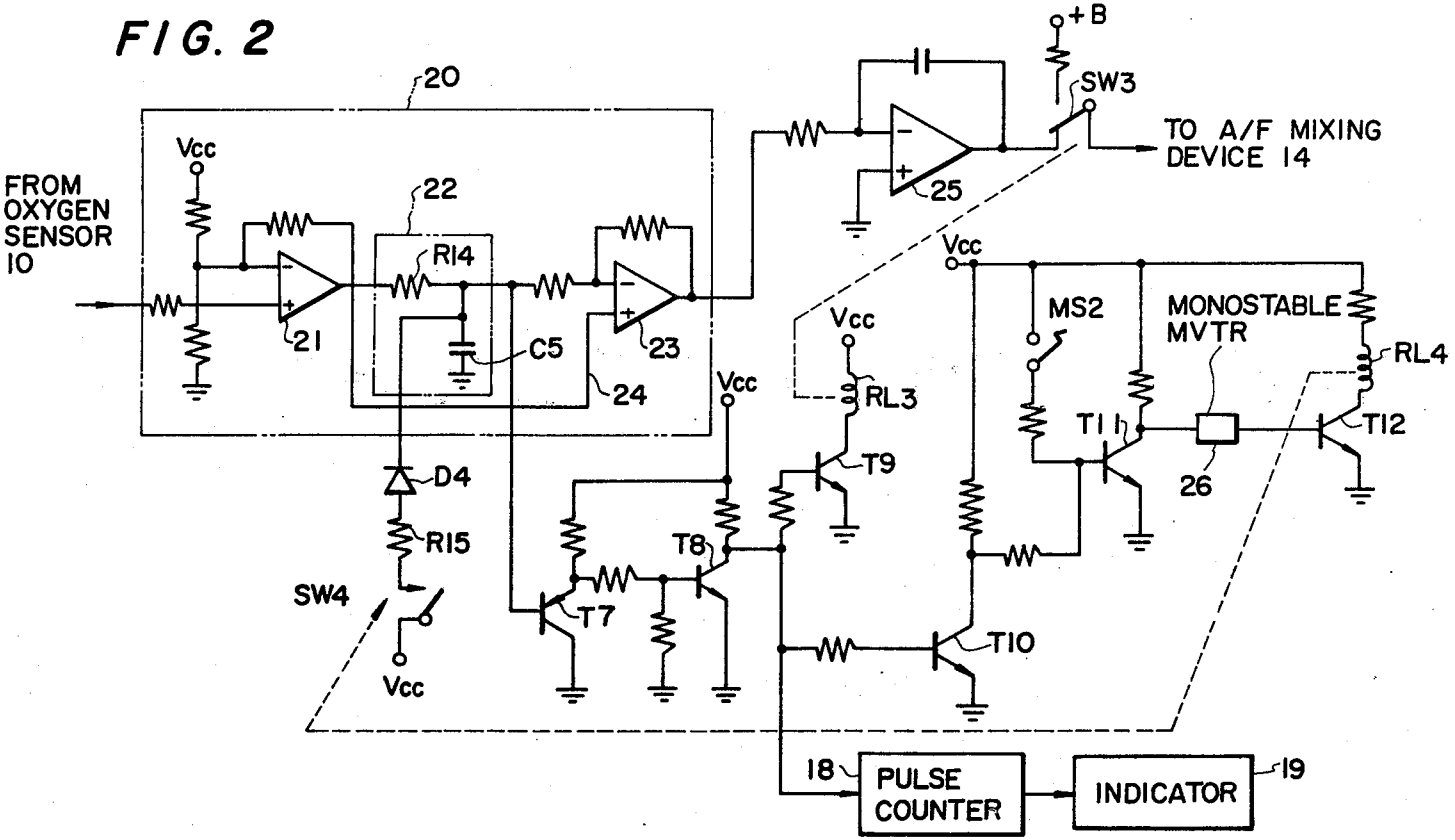
FIG. 2 is a circuit diagram of a modification of the embodiment of FIG. 1.

In a modification of the circuit of FIG. 1 shown in FIG. 2, the comparator 12 of FIG. 1 is replaced with a circuit 20 which includes operational amplifiers 21 and 23. Amplifier 21 has its noninverting input connected to the output of oxygen sensor 10 and its inverting input connected to a reference voltage. The output of the amplifier 21 is connected to an RC filter 22 including a resistor R14 and a capacitor C5. Through resistor R14 the amplifier 21 output is connected to the inverting input of the operational amplifier 23 whose non-inverting input is connected to the output of amplifier 21 through connection 24. The operational amplifier 21 acts as a differential amplifier to compare the sensed oxygen concentration with a reference value. The output from amplifier 21 is smoothed out by the filter 22 so that the voltage developed across capacitor C5 represents a mean value of the fluctuating output of the amplifier 21. If the operating performance of the oxygen sensor 10 should change or deteriorate with time, the fluctuating range of the amplifier 21 is affected and the mean value of the amplifier 21 output will settle at a new value. The mean value serves as a reference level for the operational amplifier 23 which compares it with the fluctuating output from amplifier 21. therefore, the circuit 20 has a self-compensating function to compensate for the aging of the exhaust composition sensor 10.

To the junction point between resistor R14 and capacitor C5 of filter 22 is connected the base of a transistor T7 which senses the voltage developed across the capacitor C5 and switches on when the capacitor voltage falls below a predetermined value. The emitter of transistor T7 is connected to the base of transistor T8 to turn if off when transistor T7 is conducting. The collector of transistor T8 is connected on the one hand to the base of transistor T9 and also to the base of transistor T10. When transistor T8 is conducting, transistors T9 and T10 are turned off. Thus, transistor T9 is made conducting when the capacitor C5 has discharged. A relay coil RL3 is connected to the collector of transistor T9. The relay RL3 has its contact SW3 disposed in the output of integrator 25 and acts in a manner identical to the relay RL1 of the previous embodiment so that upon energization contact unit SW3 is operated to clamp the control loop.

The collector of transistor T10 is connected to the base of transistor T11 whose collector is connected to a monostable multivibrator 26. A manual switch MS2 is connected between the base of transistor T11 and the voltage supply Vcc to forwardly bias the transistor T11 into conduction when manually operated. The monostable multivibrator 26 is activated to produce a pulse of a predetermined duration in response to the switching off of transistor T11 when the control loop is clamped. The monostable multivibrator 26 activates a transistor T12 for the period of the pulse duration to energize a relay coil RL4 coupled to the collector thereof. The relay RL4 has its contact unit SW4 disposed in a recharging circuit connected to the capacitor C5 and the voltage supply Vcc. The recharging circuit includes a diode D4, resistor R15 and the relay contact SW4 connected in series, the operation of the recharging circuit being identical to the recharging circuit of FIG. 1.

In operation, the low voltage condition of exhaust composition sensor 10 discharges capacitor C5 to turn on transistor T7 to clamp the control loop. Simultaneously, monostable multivibrator 26 is activated to energize relay RL4 for the period of the monostable to complete the recharging circuit. Capacitor C5 is recharged so that transistor T7 is turned off so that relay RL3 is released. As long as the low voltage condition exists, the control system is clamped at intervals in a manner identical to the previous embodiment, the collector of transistor T8 delivers a train of pulses to the counter 18.

Figure 3:
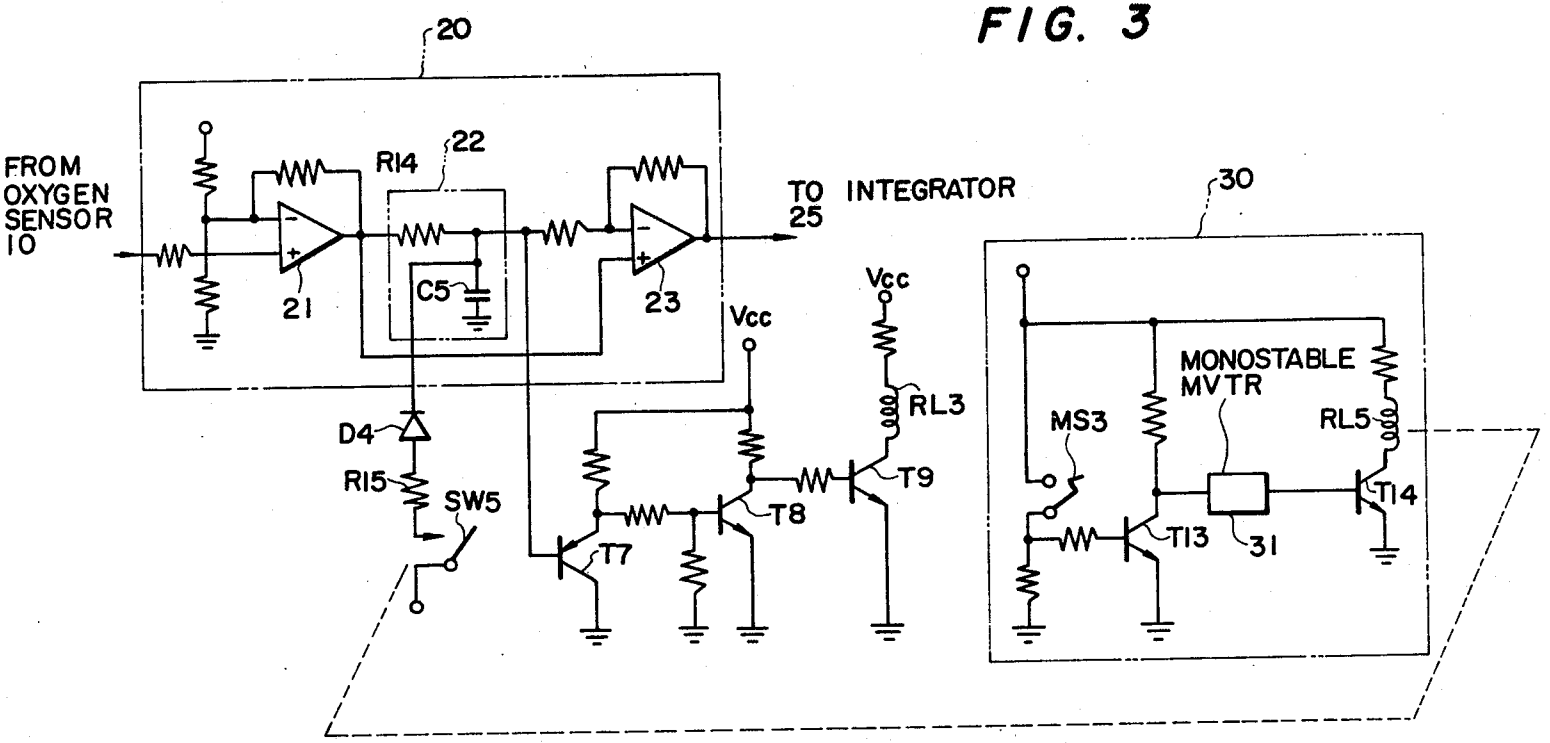
FIGS. 3 and 4 are circuit diagrams of a modification of the circuit of FIG. 2.

FIG. 3 illustrates another embodiment of the invention in which identical numerals are used to indicate identical parts to those used in FIG. 2. In this embodiment, a manually operated start switch MS3 is provided to turn on transistor T13 in a clamp release circuit 30. To the collector of transistor T13 is connected a monostable multivibrator 31, which is activated in response to a high voltage output at the collector of transistor T13 when the switch MS3 is released. The pulse output from monostable 31 is used to activate transistor T14, to the collector of which is connected a relay RL5 having its contact unit SW5 disposed in the recharging circuit comprised by diode D4 and resistor r15. The recharging circuit will thus be completed to charge capacitor C5 in response to the release of the switch MS3. When switch MS3 is operated as the engine is started, the capacitor C5 will be charged and transistor T7 turns off to prevent relay RL3 from being energized so that the control loop is prevented from being clamped during the period of the monostable 31.

Figure 4:
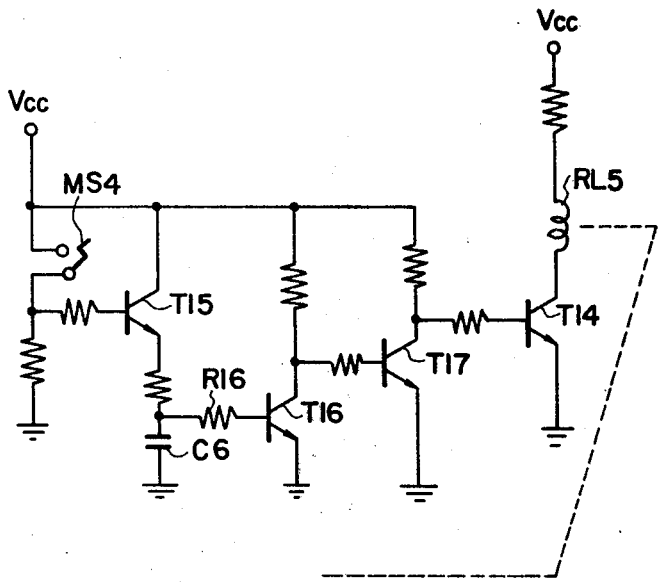

Alternatively, the clamp release circuit 30 may be replaced with a circuit 40 shown in FIG. 4, in which identical parts are designated by the same numerals as used in the FIG. 3 circuit. A capacitor C6 is connected between the emitter of transistor T15 and ground. When switch MS4 is operated to turn on transistor T15, capacitor C6 is charged to develop a biasing voltage for transistor T16 with its collector connected to the base of transistor T17 which in turn has its collector connected to the base of transistor T14. The turn-on of transistor T15 results in turn on of transistor T14 to energize relay RL5. When switch MS4 is released transistor T15 is turned off to allow capacitor C6 to discharge through resistor R16. Upon the biasing potential of transistor T16 falling below its conducting threshold, transistor T17 is turned on to turn off transistor T14. Thus capacitor C6 and resistor R16 constitute a delay element and relay RL5 remains operated for a duration commencing with the operation of switch MS4 to the time the capacitor C6 has discharged.

What is claimed is:

1. Apparatus for operating an internal combustion engine in a closed or an open loop control mode including means for supplying an air-fuel mixture to the engine in accordance with an engine operating parameter, an exhaust gas sensor for sensing the concentration of an exhaust composition of the spent gases and generating a concentration representative signal at a high voltage level when said mixture has a low air-fuel ratio and a low voltage level when said mixture has a high air-fuel ratio, means for detecting the deviation of said concentration representative signal from a reference value indicating a desired air-fuel ratio and generating a deviation representative signal, means for correcting the air-fuel ratio of the mixture in accordance with a correction signal corresponding to said deviation representative signal when said engine is operated in a closed loop control mode such that the mixture is enriched or leaned when said concentration representative signal is at said low or high voltage levels respectively, whereby the mixture has a tendency to oscillate about said desired ratio due to a delay time present in said closed control loop, said apparatus comprising:

first means for detecting the presence of said oscillation of the air-fuel ratio to cause said engine to operate in the closed loop control mode and detecting the absence of said oscillation to cause said engine to operate in an open loop control mode; and second means operative in the absence of said oscillation for suspending said open loop control mode for a certain period of time whereby the low voltage level of said contentration representative signal causes said air-fuel mixture to become enriched to produce said oscillation within said certain period of time if said exhaust gas sensor is functioning properly.

2. Apparatus as claimed in claim 1, wherein said second means is responsive to an output signal from said first means to generate a signal representing the presence of said oscillation and to apply same to the input of aid first means.

3. Apparatus as claimed in claim 2, wherein said second means is responsive to the output signal from said first means after the elapse of a delay interval.

4. Apparatus as claimed in claim 2, wherein said first means comprises a differentiator for generating a differentiator output signal in response to a voltage variation of said deviation respresentative signal, storage means for generating a time varying voltage signal in response to said differentiator output signal, and means for causing said engine to operate in the closed loop control mode in response to said time varying voltage signal crossing a predetermined voltage level and causing said engine to operate in the open loop control mode in response to said time varying voltage signal crossing said predetermined voltage level in the opposite direction.

5. Apparatus as claimed in claim 4, wherein said second means comprises second storage means for generating a second time varying voltage signal in response to the first-mentioned time varying voltage signal crossing said predetermined voltage level in the opposite direction, and means responsive to said second time varying voltage signal crossing a second predetermined voltage level to charge the first-mentioned storage means to cause said engine to operate in the closed loop control mode and responsive to said second time varying voltage signal crossing said second predetermined voltage level in the opposite direction to interrupt the charging of said first storage means to allow said engine to operate in the closed or open loop control mode depending on the voltage level of said first time varying voltage signal.

6. Apparatus as claimed in claim 4, wherein said second means comprises a monostable device for generating a pulse in response to the occurrence of the crossing of said time varying voltage signal in the opposite direction, and means responsive to the output signal of said monostable device to charge said storage means to allow said time varying voltage signal to cross said predetermined voltage level in the first-mentioned direction.

7. Apparatus as claimed in claim 5, further comprising a counter responsive to transitions of said engine operation between closed and open loop control modes to provide an output signal when a predetermined number of said transitions are counted, and means for providing an indication in response to the output signal from said counter.

8. Apparatus as claimed in claim 2, wherein said first means comprises an RC filter for generating a signal representative of a mean value of said deviation representative signal, and means for causing said engine to operate in the closed loop control mode in response to said mean value representative signal crossing a predetermined voltage level and causing said engine to operate in the open loop control mode in response to said mean value representative signal crossing said predetermined voltage level in the opposite direction, and further comprising means for generating a signal repesentative of the deviation of said concentration representative signal from said mean value representative signal.

9. Apparatus as claimed in claim 8, wherein said second means comprises a monostable device for generating a pulse of a predetermined duration in response to the occurrence of the crossing of said mean value representative signal in the opposite direction to charge the capacitor of said RC filter to cause the mean value representative signal to cross said predetermined voltage level in the first-mentioned direction.

10. Apparatus as claimed in claim 9, further comprising a counter responsive to transitions of said engine operation between closed and open loop control modes to provide an output signal when a predetermined number of said transitions is counted, and means for providing an indication in response to the output signal from said counter.

11. Apparatus as claimed in claim 1, wherein said second means comprises a manually operative switch and a timing element responsive to the operation of said switch to suspend said open loop control mode for a predetermined duration.

* * * * *